US009993055B2

(12) United States Patent
Waltrip

(10) Patent No.: US 9,993,055 B2
(45) Date of Patent: Jun. 12, 2018

(54) BOTTLE HOLDER AND RELATED METHODS

(76) Inventor: Mark A. Waltrip, Orlando, FL (US)

( * ) Notice: Subject to any disclaimer, the term of this patent is extended or adjusted under 35 U.S.C. 154(b) by 875 days.

(21) Appl. No.: 13/540,184

(22) Filed: Jul. 2, 2012

(65) Prior Publication Data

US 2013/0000257 A1 Jan. 3, 2013

Related U.S. Application Data

(60) Provisional application No. 61/503,834, filed on Jul. 1, 2011.

(51) Int. Cl.

| | |
|---|---|
| ***B65D 5/481*** | (2006.01) |
| ***B65D 65/00*** | (2006.01) |
| ***A45C 11/20*** | (2006.01) |
| ***B65D 85/30*** | (2006.01) |
| ***A45C 13/02*** | (2006.01) |
| ***B65D 25/04*** | (2006.01) |
| ***B65D 81/113*** | (2006.01) |
| ***B65D 81/127*** | (2006.01) |

(52) U.S. Cl.

CPC ..... *A45C 11/20* (2013.01); *A45C 13/02* (2013.01); *B65D 25/04* (2013.01); *B65D 81/113* (2013.01); *B65D 81/1275* (2013.01); *B65D 85/30* (2013.01); *A45C 2013/026* (2013.01); *A45C 2200/20* (2013.01)

(58) Field of Classification Search

CPC ..... F25D 3/08; F25D 2303/0822; F25D 2303/08222; F25D 2331/805; F25D 2331/803; F25D 31/007; B65D 31/12; B65D 85/305; B65D 2501/24222; B65D 2501/24286; B65D 2501/24312

USPC ..... 206/139, 427, 428, 433, 591, 196; 53/398, 412, 467, 468, 473, 488, 48.1, 53/147, 235, 263

See application file for complete search history.

(56) References Cited

U.S. PATENT DOCUMENTS

| | | | | | |
|---|---|---|---|---|---|
| 565,508 | A | * | 8/1896 | Rothenbach | A47J 41/0077 206/139 |
| 848,889 | A | * | 4/1907 | Fitzgerald | A45C 9/00 190/16 |
| 1,079,789 | A | * | 11/1913 | Merker | B65D 5/48038 217/31 |
| 1,428,594 | A | * | 9/1922 | Kainer | B65D 85/328 217/34 |
| 1,448,338 | A | * | 3/1923 | Drew | B65D 85/305 217/22 |

(Continued)

OTHER PUBLICATIONS

International Searching Authority; PCT International Search Report and Written Opinion dated Nov. 28, 2012; entire document.

*Primary Examiner* — Tri Mai

(74) *Attorney, Agent, or Firm* — Allen Dyer Doppelt & Gilchrist P.A.

(57) ABSTRACT

A bottle holder includes a case assembly and at least one padding assembly. The case assembly includes a body defining at least one compartment and having an open end giving access to the at least one compartment dimensioned to fully accommodate a bottle inserted axially, and a lid attached to the body and selectively closeable to cover the open end of the body and enclose the bottle in the at least one compartment. The at least one padding assembly is arranged in the at least one compartment and is dimensioned to be partially compressed between the bottle and walls of the at least one compartment.

9 Claims, 7 Drawing Sheets

(56) References Cited

U.S. PATENT DOCUMENTS 1,917,886 A * 7/1933 Hogan ..... 206/433
1,962,492 A * 6/1934 Fallert ..... 229/122.34
1,990,675 A * 2/1935 Sinz et al. ..... 217/19
2,013,240 A * 9/1935 Harvey ..... B65D 5/48028 217/30
2,123,031 A * 7/1938 Weiner ..... A47J 41/00 126/261
2,433,676 A * 12/1947 Ringler ..... 206/171
2,555,126 A * 5/1951 Greve ..... F25D 3/08 190/19
2,555,788 A * 6/1951 Donaldson ..... A45C 11/20 206/545
2,821,299 A * 1/1958 Crary et al. ..... 206/162
2,979,246 A * 4/1961 Liebeskind ..... 206/523
3,029,999 A * 4/1962 De Paul ..... 206/196
3,263,893 A * 8/1966 Weiss ..... 206/196
3,294,308 A * 12/1966 Tress et al. ..... 206/521
3,387,650 A * 6/1968 Masshake ..... A45C 11/20 126/246
4,228,908 A * 10/1980 Tweeton ..... A45C 11/20 206/545
4,295,345 A * 10/1981 Atkinson ..... A45C 11/20 206/427
4,319,682 A * 3/1982 Wright ..... B65D 71/0022 206/180
4,339,039 A * 7/1982 Mykleby ..... B65D 81/107 206/523
4,428,484 A * 1/1984 Rattay et al. ..... 206/548
4,620,426 A * 11/1986 Pitchford ..... F25D 3/08 224/148.3
4,681,225 A 7/1987 Schuster
4,721,237 A * 1/1988 Leslie ..... 224/148.3
5,027,972 A * 7/1991 Bartholomew .... B65D 81/3216 220/526
5,095,718 A * 3/1992 Ormond et al. ..... 62/457.5
5,553,709 A * 9/1996 Wharton et al. ..... 206/446
5,577,616 A * 11/1996 Liang ..... B65D 81/107 206/593
5,758,513 A * 6/1998 Smith ..... 62/457.5
5,785,239 A * 7/1998 Campbell, II ..... B65D 5/48038 217/22
5,791,481 A * 8/1998 Thomas ..... B65D 25/04 206/581
5,860,525 A * 1/1999 Bellehchili ..... 206/443
6,053,317 A * 4/2000 Morris et al. ..... 206/433
6,067,813 A * 5/2000 Smith ..... 62/371
6,151,910 A * 11/2000 Hazen ..... 62/457.2
6,536,654 B2 3/2003 Reynolds
7,565,974 B2 * 7/2009 Adams, Jr. ..... 206/427
8,448,782 B2 * 5/2013 Chin ..... 206/217
2004/0149600 A1 8/2004 Wolter et al.
2005/0155904 A1 * 7/2005 Chen ..... B65D 5/643 206/719
2006/0196218 A1 * 9/2006 Mogil et al. ..... 62/457.4
2006/0254950 A1 * 11/2006 Barlog et al. ..... 206/538
2008/0093244 A1 * 4/2008 Binah et al. ..... 206/433
2008/0135554 A1 * 6/2008 Hill ..... B65D 81/052 220/215
2008/0229710 A1 * 9/2008 Caven ..... 53/263
2009/0173646 A1 * 7/2009 Blomberg ..... 206/139
2013/0000257 A1 * 1/2013 Waltrip ..... 53/449

* cited by examiner

BOTTLE HOLDER AND RELATED METHODS

CROSS-REFERENCE TO RELATED APPLICATION

This application claims the benefit of U.S. Provisional Application Ser. No. 61/503,834, filed on Jul. 1, 2011, the contents of which are herein incorporated by reference in their entirety.

FIELD OF THE INVENTION

The present invention relates to devices for holding and transporting beverage bottles, and more particularly, wine bottles.

BACKGROUND OF THE INVENTION

Many beverages are stored in bottles prior to consumption. Virtually every bottle is subject to breakage if mishandled, and particularly bottles made of glass or ceramic materials. Accordingly, care must be taken when transporting such bottles to avoid, or at least minimize breakage. This can be particularly challenging when bottles must be placed in overhead compartments in planes, trains and the like, or checked into a baggage compartment. Under current regulation of the Transportation Security Administration (TSA) prohibiting the carrying-on of liquid containers over 3.4 fluid ounces, hoping for cautious baggage handlers and a well-stowed baggage compartment are the only option for wine bottles during air travel from U.S. airports.

Additionally, many bottled beverages can represent a significant investment. For example, many bottles of wine retail for 100 USD or more. Thus, in addition to the inconvenience, mess and possible cut hazards posed by broken bottles, in some instances breakage can result in significant financial loss.

Various devices have been utilized over the years to provide some protection and cushioning of bottles. Bags, satchels and other devices intended for personal use can be convenient to carry, but typically offer little protection against impact or improper handling. Crates and the like for bulk shipping of bottles may offer more protection, but are not suitable for routine, personal use. Thus, in spite of such devices, there is a shortage of suitable bottle holders for personal use during travel, particularly airline, train and boat travel, and further improvements are still possible.

SUMMARY OF THE INVENTION

In view of the foregoing, it is an object of the present invention to provide an improved bottle holder and related methods of use. According to an embodiment of the present invention, a bottle holder includes a case assembly and at least one padding assembly. The case assembly includes a body defining at least one compartment and having an open end giving access to the at least one compartment dimensioned to fully accommodate a bottle inserted axially, and a lid attached to the body and selectively closeable to cover the open end of the body and enclose the bottle in the at least one compartment. The at least one padding assembly is arranged in the at least one compartment and is dimensioned to be partially compressed between the bottle and walls of the at least one compartment.

According to an aspect of the present invention, the bottle for which the at least one compartment and padding assembly are dimensioned is a 750 milliliter (mL) wine bottle. According to another aspect of the present invention, the padding assembly lines walls of the at least one compartment.

According to a method aspect, a method includes inserting a bottle in the axial direction into a compartment defined by the body of a bottle holder, such that the bottle slightly compresses a padding assembly extending between the bottle and the compartment.

These and other objects, aspects and advantages of the present invention will be better understood in view of the drawings and following detailed description of preferred embodiments.

DETAILED DESCRIPTION OF PREFERRED EMBODIMENTS

Figure 1:
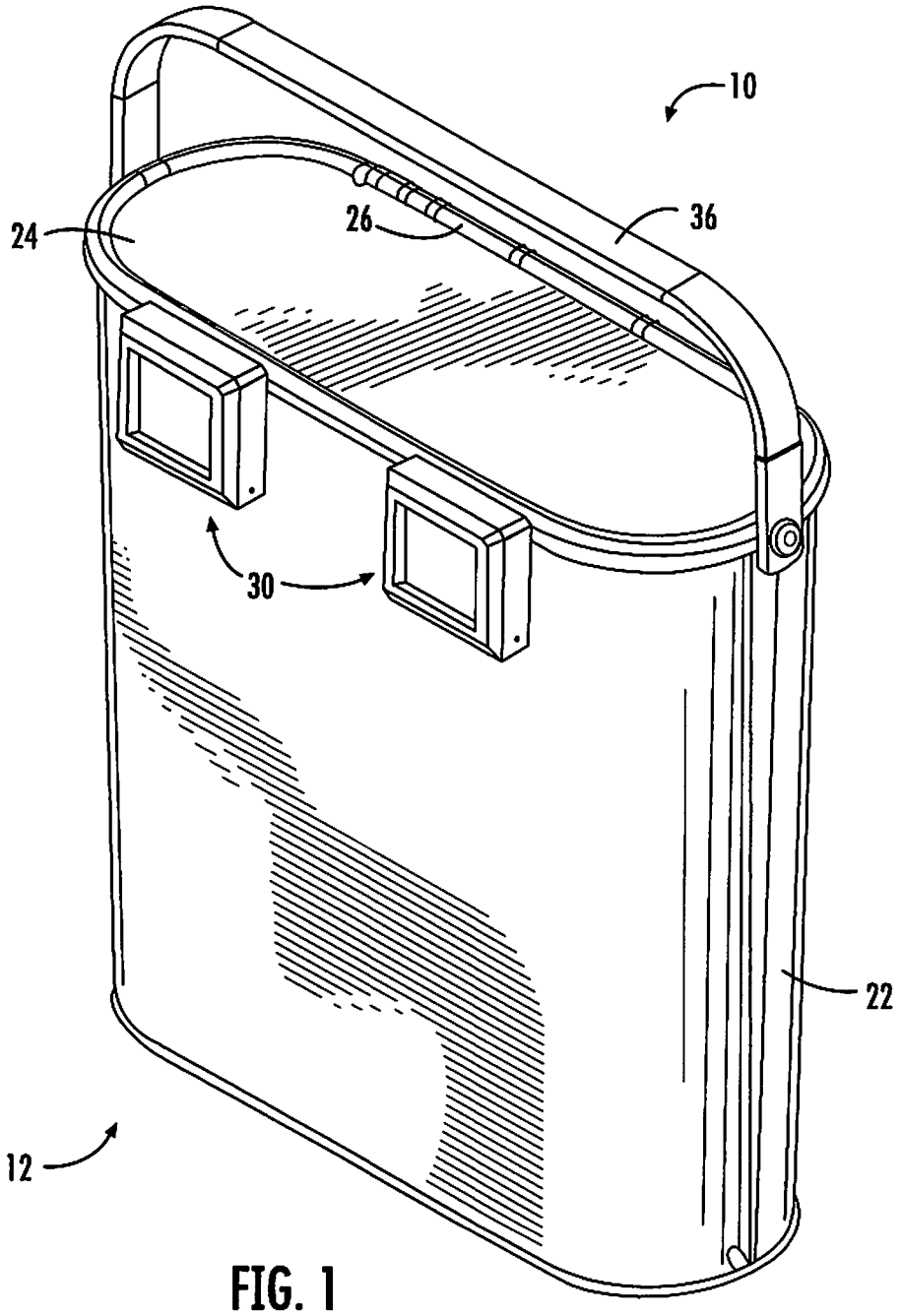
FIG. 1 is a perspective view of a bottle holder, including a case assembly and a plurality of bottle inserts, according to an embodiment of the present invention.
Figure 2:
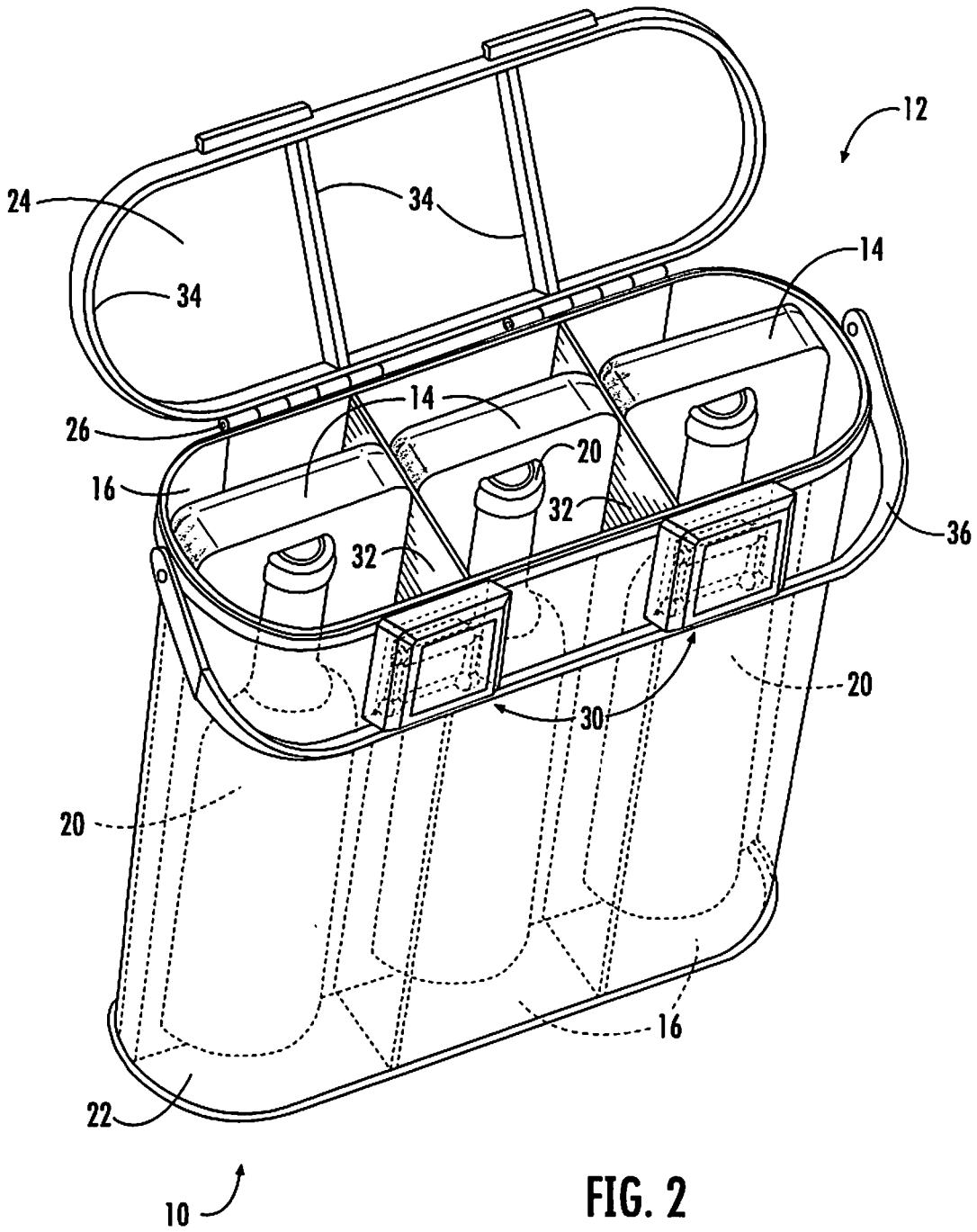
FIG. 2 is a perspective view of the bottle holder of FIG. 1, with the case assembly open and partially transparent to show internal details.

Referring to FIGS. 1 and 2, according to an embodiment of the present invention, a bottle holder 10 includes a case assembly 12 and one or more bottle inserts 14. In the depicted embodiment, the case assembly 12 is partitioned into a plurality of compartments 16. One bottle insert 14 is closely accommodated within each of the compartments and can safely hold a bottle 20 therein.

The case assembly 12 includes a body 22 open at an upper end thereof and a lid 24 operable to close the upper end. The lid 24 is preferably pivotably attached to the body 22 by a hinge 26 and releasably securable in the closed position by a plurality of clasps 30 or other releasable fasteners.

The body 22 includes a plurality of generally parallel divider panels 32, with the compartments 16 being defined therebetween. Along a centerline thereof, the compartments 16 are preferably approximately the same width, such that a given bottle insert 14 can be closely accommodated in any compartment 16. Advantageously, grooves 34 are defined in a lower surface of the lid 24 to accommodate upper edges of the body 22, including upper edges of the divider panels 32. As a result, the compartments 16 are more effectively divided and the overall rigidity of the case assembly 12 is increased. Also, a seal or gasket can be accommodated in the grooves 34, such that a fluid seal is formed between the compartments 16 when the lid 24 is closed. Accordingly, breakage of a bottle in one compartment 16 will not adversely impact the bottles in adjacent compartments 16.

Preferably, the body 22 and lid 24 are made of a plastic or other generally rigid material with suitable strength and impact resistance. A handle 36 can be attached to the body 22 to facilitate carrying of the bottle holder 10. Advantageously, the handle 36 can be pivotably mounted to the body 22, so as not to interfere with the opening of the lid 24 or the insertion of removal of the bottle inserts 14.

Figure 3:
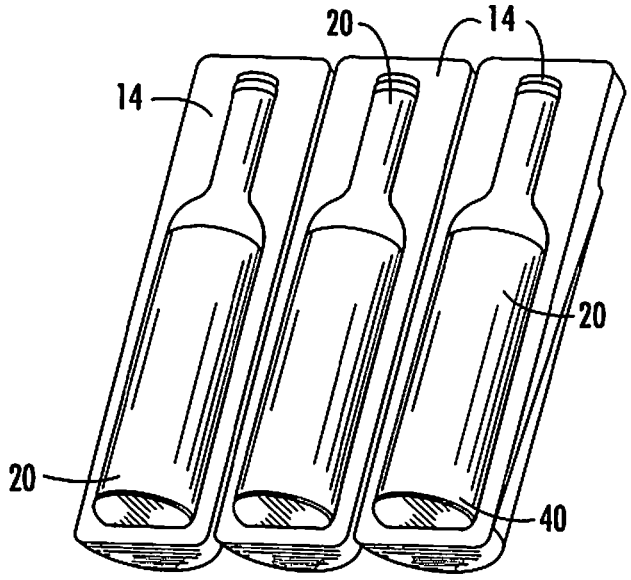
FIGS. 3 and 4 are perspective views of the bottle inserts of FIG. 1.
Figure 4:
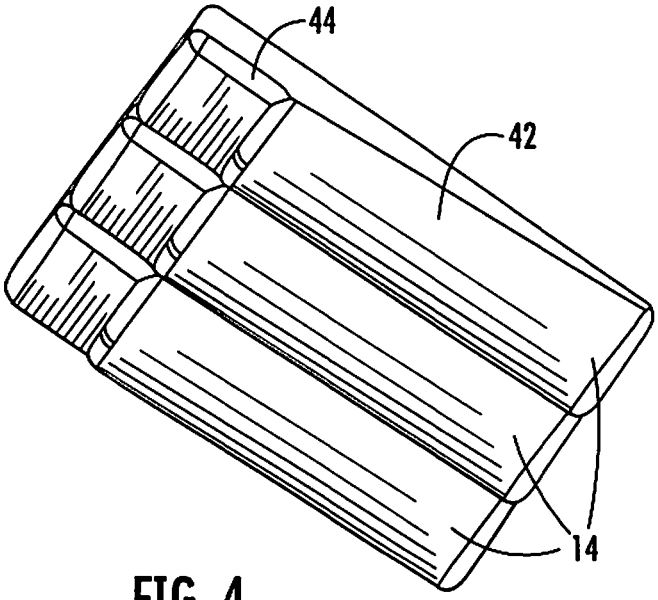

Referring to FIGS. 3 and 4, the bottle inserts 14 are preferably formed of a foam, or other at least partially compressible material, soft enough to provide cushioning of the bottles for protection while stiff enough to securely retain the bottles 20 therein.

The width of each bottle insert 14 is preferably approximately equal such than any insert 14 can be closely accommodated within any compartment 16. The width of each insert 14 can be slightly greater than that of the compartments 16, such that compression of the insert 14 results in a secure interference fit.

A forward side (FIG. 3) of each bottle insert defines a bottle cavity 40 corresponding closely to the shape of approximately half the bottle 20 to be held therein. Advantageously, the cavity 40 can be dimensioned slightly smaller than the bottle 20 to ensure a secure interference fit.

On a rear side (FIG. 4) of each bottle insert 14, a rounded lower portion 42 and a flat upper portion 44 are formed. The lower portion 42 is deeper than the upper portion 44, allowing for the bottle cavity 40 to be deeper in this area and completely cover the corresponding bottle 20 half. The upper portion 44 accommodates the neck of the bottle 20, and need not be as deep.

Advantageously, the more expansive lower portion 42 helps keep the bottle insert 14 securely positioned within its respective compartment 16. The rounded profile of the lower portion 42 also allows the compartments to have different wall shapes away from their centerline, while still securely accommodating inserts 14 of the same general shape. For example, the side compartments 16 can have rounded outer walls while the central compartment 16 can have a generally square cross section.

The narrower upper portion 44 of the bottle insert 14 facilitates grasping of the bottle insert by a user. As a result, insertion and removal of the bottle inserts 14 into and from the compartments 16 is more readily accomplished.

In use, with reference to FIGS. 1-4, depending on how many bottles 20 a user desires to transport, one or more bottles 20 are inserted into bottle cavities 40 of a corresponding number of bottle inserts 14. With the lid 24 open and the handle 36 pivoted away from the opening of the body 22, the bottle inserts 14 are then arranged into the compartments 16 of the body with the upper portions 44 upward. Any unused bottle inserts 14 can be stored in respective compartments 16 for convenience. The lid 24 is closed and secured by the clasps 30.

The bottle holder 10 can then be transported with the bottles 20 stored safely therein; for instance, by carrying via the handle 36. When the bottles 20 reach their destination, or are otherwise desired, the handle 36 is pivoted out the way, and the lid 24 is unclasped and opened. The bottle inserts 14 for the desired bottles 20 are withdrawn by grasping the upper portions 44 and pulling the inserts out of the compartments 16. The bottle holder 10 can be re-used as often as needed.

From the foregoing, it will be appreciated that the bottle holder of the present invention provides a convenient and secure means for transporting bottles, while allowing easy access thereto. In particular, the use of separate removable bottle inserts facilitates a top-loading design, allowing for a smaller opening in the body and simpler and less expansive lid.

Additionally, the use of separate bottle inserts allows for enhanced flexibility in securely transporting bottles of varying shapes. For instance, bottle inserts having differently-shaped cavities closely tailored to different bottle shapes, such as traditional Bordeaux, Burgundy and Champagne bottle shapes, can be interchangeably used within the same body.

Figure 5:
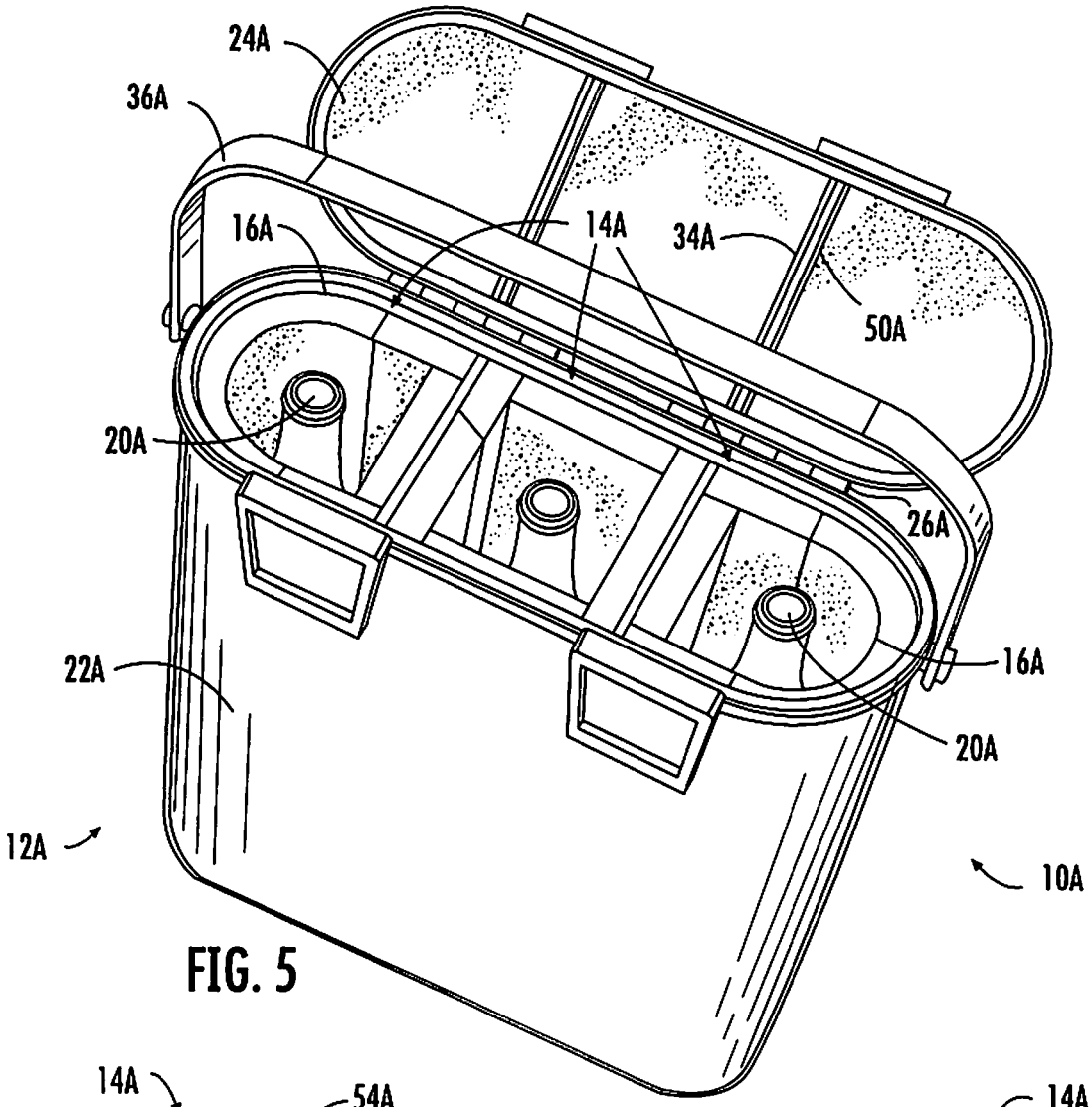
FIG. 5 is a perspective view of a bottle holder, including a case assembly and a plurality of padding assemblies, according to another embodiment of the present invention.

According to another embodiment of the present invention, with reference to FIG. 5, a bottle holder 10A includes a case assembly 12A and one or more padding assemblies 14A. Similar elements are referred to with similar reference numerals in alternate embodiments, with an alphabetical suffix. Except as particularly described, the structure and function of alternate embodiments are substantially the same.

In the case assembly 12A, a gasket 50A is arranged in the grooves 34A of the lid 24A. Additionally, instead of bottle inserts 14, the bottle holder 10A uses the padding assemblies 14A to cushion the bottles 20A in each compartment 16A. Each padding assembly 14A lines the walls of its compartment 16A and is dimensioned to provide at least four points of contact with its respective bottle 20A at the widest part thereof.

Figure 6:
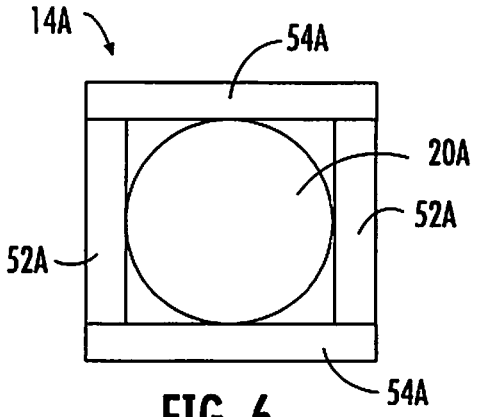
FIGS. 6 and 7 are schematic top views of the pad assemblies of FIG. 5.

Referring to FIG. 6, the padding assembly 14A for the center compartment 16A includes a pair of opposed first side pads 52A and a pair of opposed second side pads 54A. The distance between the opposed pairs 52A and 54A are approximately equal and less than the maximum diameter of a typical 750 mL wine bottle, such that, once inserted, the bottle is firmly engaged at four points along its circumference by slightly compressed pads.

Figure 7:
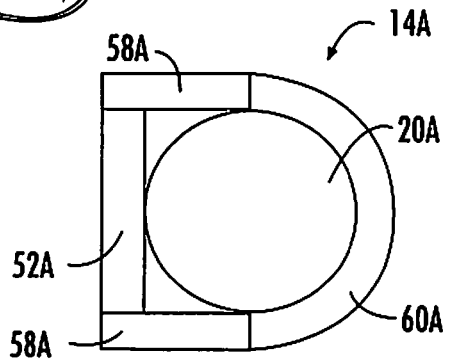

Referring to FIG. 7, the padding assemblies 14A for the side compartments 16A include one side pad 52A, a pair of opposed partial side pads 58A and a curved side pad 60A. The curved side pad 60A is approximately semi-circular, and the distance between the centers of the side pad 52A and curved side pad 60A is equal to the diameter of the semi-circular pad 52A and less than the maximum diameter of the typical 750 mL wine bottle. As a result, the bottle is firmly engaged at one point by the slightly compressed pad 52A, and substantially continuously along the opposite half of its circumference by the curved side pad 60A.

Figure 8:
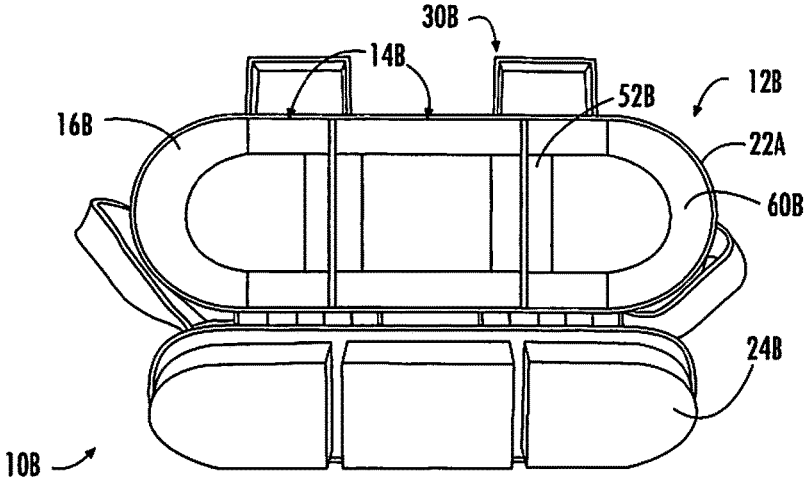
FIG. 8 is a perspective view of a bottle holder, according to a further embodiment of the present invention.
Figure 9:
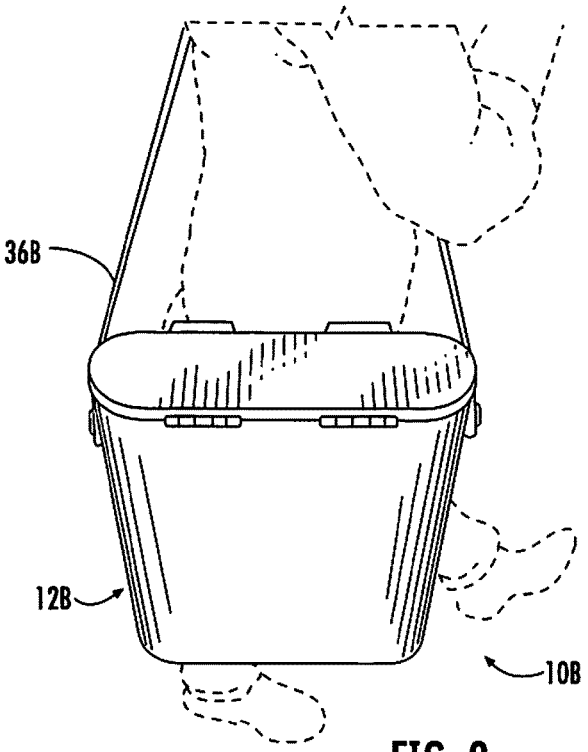
FIG. 9 is another perspective view of the bottle holder of FIG. 8.

According to a further embodiment of the present invention, referring to FIGS. 8 and 9, a bottle holder 10B includes a case assembly 12B and one or more padding assemblies 14B. The case assembly 12B is covered in leather, enhancing its aesthetic appeal and offering an additional degree of protection against impact. Also, the case assembly 12B includes a strap 36B, long enough to extend over the shoulder of a user to facilitate carrying of the bottle holder 10B. Additionally, in the outer padding assemblies 14B, the curved side pads 60B extend all the way to the side pad 52B, such that the side pads 60B effectively integrate the partial side pads 58A of the previous embodiment. Lid padding 62B is also clearly visible.

Figure 10:
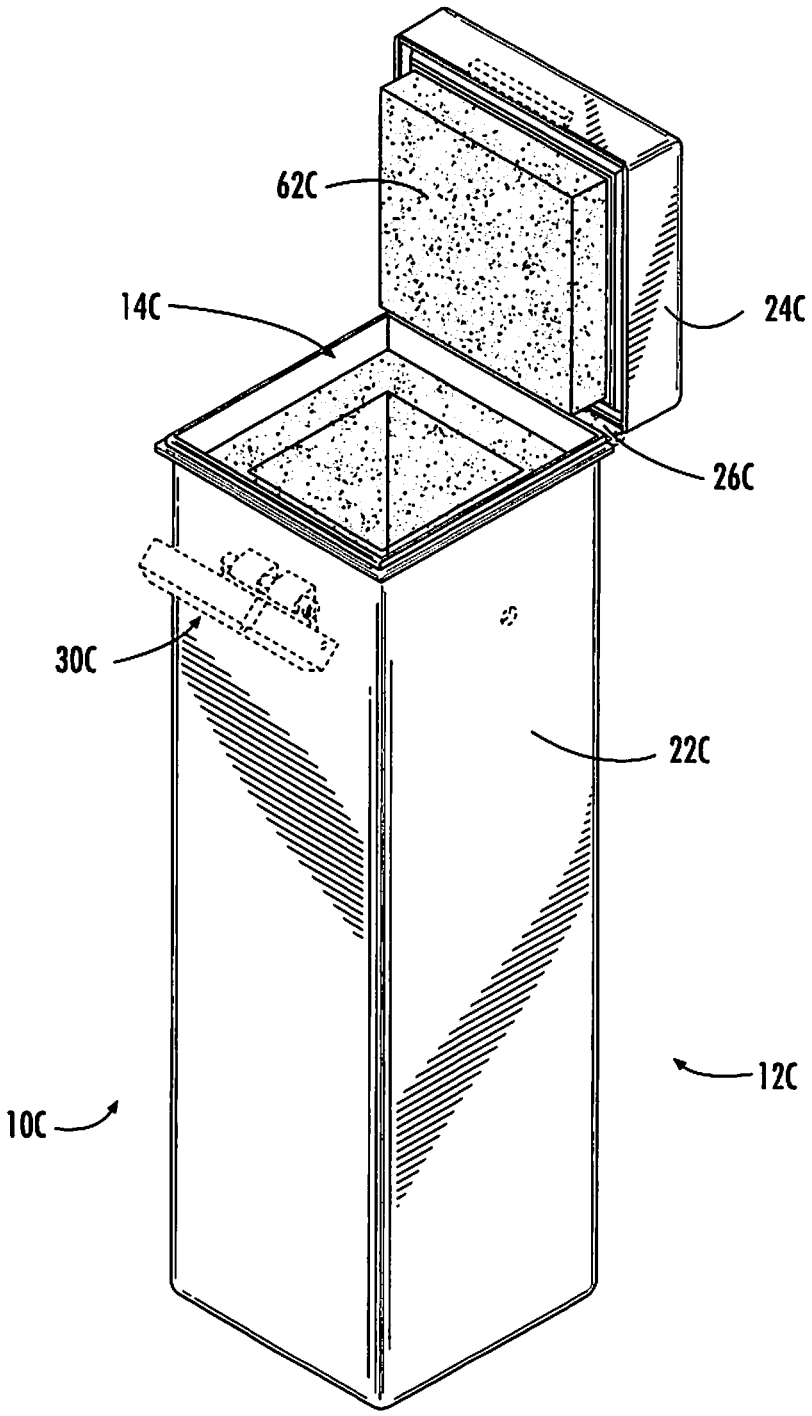
FIGS. 10 and 11 are perspective views of bottle holders, according to additional embodiments of the present invention.
Figure 11:
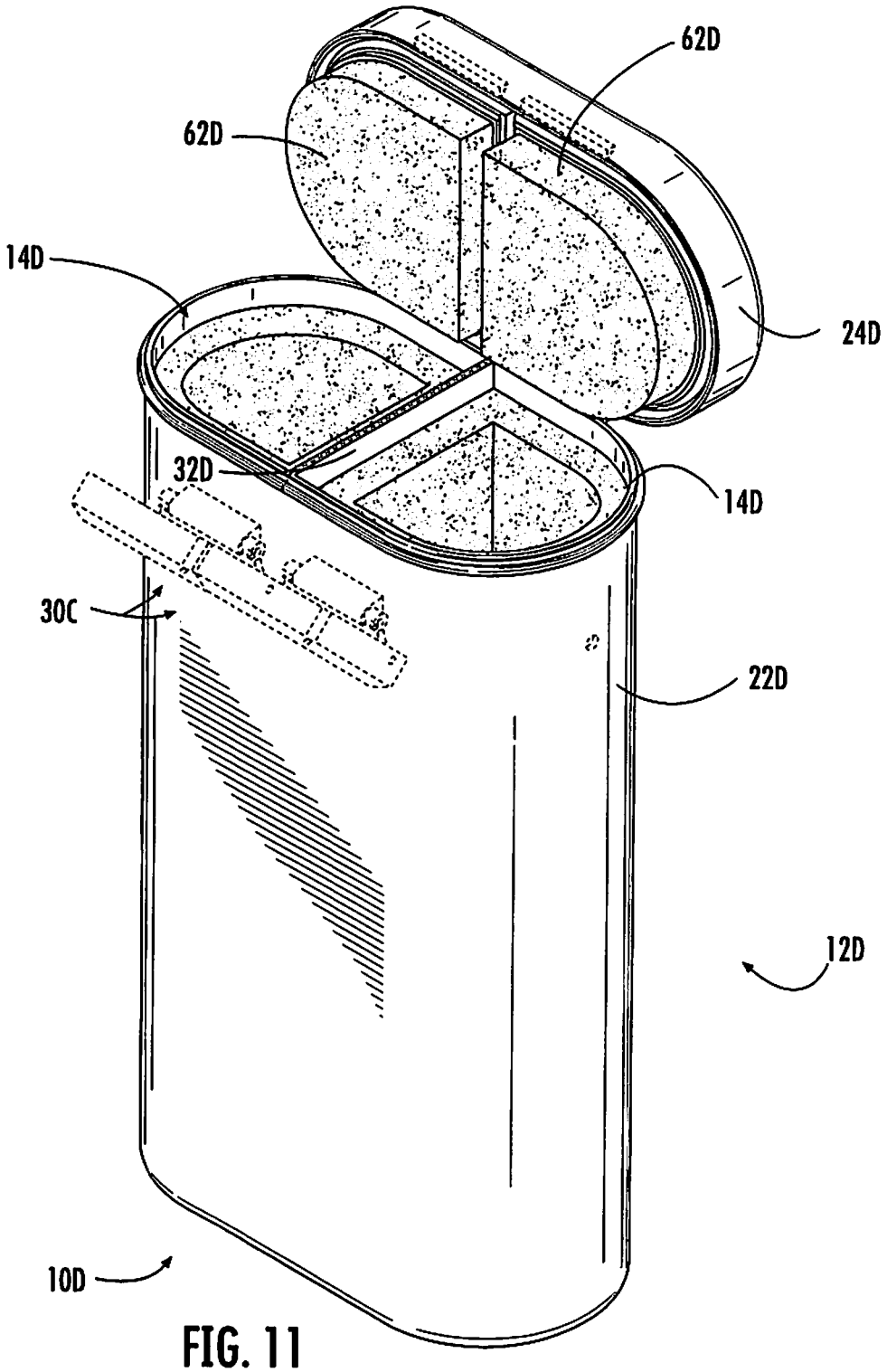

It will be appreciated that the present invention is not necessarily limited to the particular shapes and configurations depicted. For example, the present invention can be readily adapted for bottle holders holding only two or one bottles, as well bottle holders holding more than three bottles. For instance, referring to FIG. 10, a bottle holder 10C is configured to hold a single bottle in a single compartment 16C, with a generally square cross section. Referring to FIG. 11, a bottle holder 10D is configured to hold two bottles in two compartments 16C with rounded outer walls.

As is apparent from the various disclosed embodiments, the bottle holders according to the present invention can provide a convenient carrying case for personal use with portability and style comparable to existing personal carrying bags and the like, while offering protection for the contents in many cases equivalent or superior to bulk transport devices.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A bottle holder comprising:

a case assembly including:

a body including at least one divider panel defining a plurality of compartments and having an open end giving access to the plurality of compartments, each of the plurality of compartments being dimensioned to fully accommodate a bottle inserted axially:

a lid attached to the body and selectively closeable to cover the open end of the body and enclose the bottle in each of the plurality of compartments;

a plurality of padding assemblies, each padding assembly being arranged ire a respective one of the plurality of compartments and dimensioned to be partially compressed between the bottle and walls of the respective one of the plurality of compartments; and a plurality of 750 milliliter (mL) wine bottles, a respective one of the plurality of bottles securely retained in each of the plurality of padding assemblies;

wherein a fluid-tight seal is formed between the body and the lid around each of the plurality of compartments, such that any free liquid in airy of the plurality of compartments is contained therein;

wherein grooves are defined in the lid to accommodate upper edges of the body including an upper edge of the at least one divider panel;

wherein a gasket is accommodated in the grooves;

wherein the Plurality of padding assemblies line the walls of the plurality of compartments;

wherein at least two of the compartments have rounded outer walls, wherein, in each of the at least two compartments having rounded outer walls a corresponding rounded portion a respective one of the padding assemblies contacts the respective one of the plurality of bottles stored therein substantially continuously;

wherein each of the at least two compartments having rounded outer walls also has a flat wall facing the rounded outer wall, the respective one of the padding assemblies in each of the at least two compartments also contacting the respective one of the plurality of bottles stored therein at one point along the flat wall; and wherein the plurality of padding assemblies also line the lid facing the plurality of compartments.

2. The bottle holder of claim 1, wherein the case assembly further includes at least one of a handle and a strap attached to the body.

3. The bottle holder of claim 1, wherein the plurality of compartments includes a compartment with a square cross section between the at least two compartments having rounded outer walls.

4. The bottle holder of claim 3, wherein, in the compartment with the square cross section, a respective one of the padding assemblies is configured, such that there are at least four points of contact between the respective one of the padding assemblies around a circumference of the respective one of the plurality of bottles stored therein.

5. The bottle holder of claim 1, herein at least one of the padding assemblies includes a bottle insert configured to accommodate respective one of the plurality of bottles stored therein, the bottle insert being removably accommodated within at least one of the compartments.

6. The bottle holder of claim 5, wherein the bottle insert defines a bottle cavity corresponding to the shape of approximately one-half of the respective one of the plurality of bottles stored therein and dimensioned smaller than, the bottle, the bottle insert having an uncompressed width greater than a width of the at least one compartment.

7. The bottle holder of claim 1, wherein the case assembly further includes a covering applied to outer surfaces of the body and lid.

8. The bottle holder of claim 7, wherein the covering is leather.

9. The bottle holder of claim 1, wherein the body and lid are made of a rigid material.

* * * * *